US007637064B2

(12) United States Patent
Jessen

(10) Patent No.: US 7,637,064 B2
(45) Date of Patent: Dec. 29, 2009

(54) BUILDING MATERIAL ANCHOR

(76) Inventor: Mark E. Jessen, P.O. Box 1063, Dripping Springs, TX (US) 78620-1063

( * ) Notice: Subject to any disclaimer, the term of this patent is extended or adjusted under 35 U.S.C. 154(b) by 410 days.

(21) Appl. No.: 11/257,995

(22) Filed: Oct. 26, 2005

(65) Prior Publication Data

US 2007/0101669 A1 May 10, 2007

(51) Int. Cl.
*E04F 13/02* (2006.01)
*B65G 5/00* (2006.01)

(52) U.S. Cl. ..... 52/454; 405/55

(58) Field of Classification Search ..... 52/443, 52/449, 454, 169.14, 169.7, 741.15; 405/129.75, 405/129.6, 53, 55
See application file for complete search history.

(56) References Cited

U.S. PATENT DOCUMENTS 1,411,138 A * 3/1922 Unfug ..... 52/441
1,804,132 A * 5/1931 Tashjian ..... 52/334
3,094,813 A * 6/1963 Van Rensselaer ..... 52/344
4,466,937 A * 8/1984 Johnston et al. ..... 264/256
4,670,205 A * 6/1987 Montierth ..... 264/71
4,768,324 A * 9/1988 Hibbard ..... 52/742.14
5,140,794 A * 8/1992 Miller ..... 52/309.12
5,174,083 A * 12/1992 Mussell ..... 52/169.1
5,417,017 A * 5/1995 Toutountzis ..... 52/101
5,426,896 A * 6/1995 Sloma ..... 52/2.13
5,664,378 A * 9/1997 Bettigole et al. ..... 52/414
5,697,195 A * 12/1997 Maylon ..... 52/344
5,820,958 A 10/1998 Swallow
5,930,965 A * 8/1999 Carver ..... 52/320
6,182,412 B1 2/2001 Traxler
6,298,610 B2 * 10/2001 Traxler ..... 52/101
6,328,501 B1 * 12/2001 Gimbert ..... 405/135
6,357,191 B1 * 3/2002 Ault et al. ..... 52/336
6,526,714 B1 * 3/2003 Billings et al. ..... 52/309.8
6,546,679 B1 4/2003 Bushberger
6,759,135 B2 7/2004 Bramlett et al.
6,780,485 B2 8/2004 McCain
6,861,141 B2 3/2005 Buccellato et al.
7,165,368 B2 * 1/2007 Knapp ..... 52/449
2001/0039773 A1 * 11/2001 Bot ..... 52/259
2002/0108339 A1 * 8/2002 Adebar et al. ..... 52/363
2004/0231276 A1 * 11/2004 Patrick et al. ..... 52/633
2004/0250488 A1 12/2004 Rodlin

* cited by examiner

*Primary Examiner*—Gay Ann Spahn
*Assistant Examiner*—Joshua Ihezie
(74) *Attorney, Agent, or Firm*—Stephen R. Greiner

(57) ABSTRACT

A building material anchor including a resilient pad. A resilient, openwork tube is affixed to the top of the pad. An adhesive layer coats the bottom of the pad.

2 Claims, 2 Drawing Sheets

BUILDING MATERIAL ANCHOR

FIELD OF THE INVENTION

The present invention relates generally to building structures and, more particularly, to settable material receiving backers fixed to furring, joists, studs, and other substrates.

BACKGROUND OF THE INVENTION

Backyard ponds have become a popular landscape feature. Lush plants and soft blooms extending upwardly from the surface of a small pool of water, when considered only from a monetary standpoint, add to the resale value of a home. Of course, these things, along with goldfish and koi swimming beneath the water's surface, offer a soothing diversion for homeowners.

Improvements in the construction of backyard ponds have lowered costs, making them affordable by all. Today, most ponds are formed by digging a hole in the ground and, then, lining the hole with plastic sheeting. Afterward, the sheeting is anchored to the ground by positioning a ring of stones atop the liner and around the hole. The stones are cemented to one another to make a border that is stable and can be walked upon. Finally, the lined hole is filled with water, plants, and fish. A pump and a filter can be installed, if desired, to circulate and clean the water.

Unfortunately, the popular method of constructing backyard ponds is not without its drawbacks. One troublesome one is the tendency for bordering stones to become loose over time. The principal cause of this is the inability of cement to bond to the plastic sheeting used to line a pond. Thus, a pond that receives a substantial amount of foot traffic is likely to require frequent repairs wherein the cement beneath and between the stones is replaced.

SUMMARY OF TH INVENTION

In light of the problems associated with the durability of backyard ponds, it is a principal object of the invention to provide a building material anchor that permits stone, brick, cast block and other solid material to be firmly bonded to a substrate without resort to the use of penetrating fasteners. Thus, the requirement that stones surrounding a backyard be periodically recemented in place will become a thing of the past through the use of the anchor.

It is another object of the invention to provide a building material anchor of the type described that requires neither prolonged training and nor special tools to use. In fact, the anchor is easy and intuitive to install, requiring just a few minutes of instruction and practice to master the process.

It is a further object of the invention to provide a building material anchor of the type describes that can be used to secure objects to substrates that are either flat or irregularly contoured.

It is an additional object of the invention to provide a building material anchor that is waterproof and impervious to weathering.

It is an object of the invention to provide improved elements and arrangements thereof in a building material anchor for the purposes described that is lightweight in construction, inexpensive to manufacture, and dependable in use.

Briefly, the building material anchor in accordance with this invention achieves the intended objects by featuring a rubber pad and a resilient, openwork tube positioned atop the pad. The openwork tube is formed from a sheet of plastic mesh whose opposite ends are rolled back upon one another so as to overlap. A number of rivets penetrate the overlapping ends of the sheet of plastic mesh so as to affix the openwork tube to the pad. A pressure-sensitive adhesive layer coats the bottom of the pad and, prior to use of the anchor, a protective release liner covers the pressure-sensitive adhesive layer.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
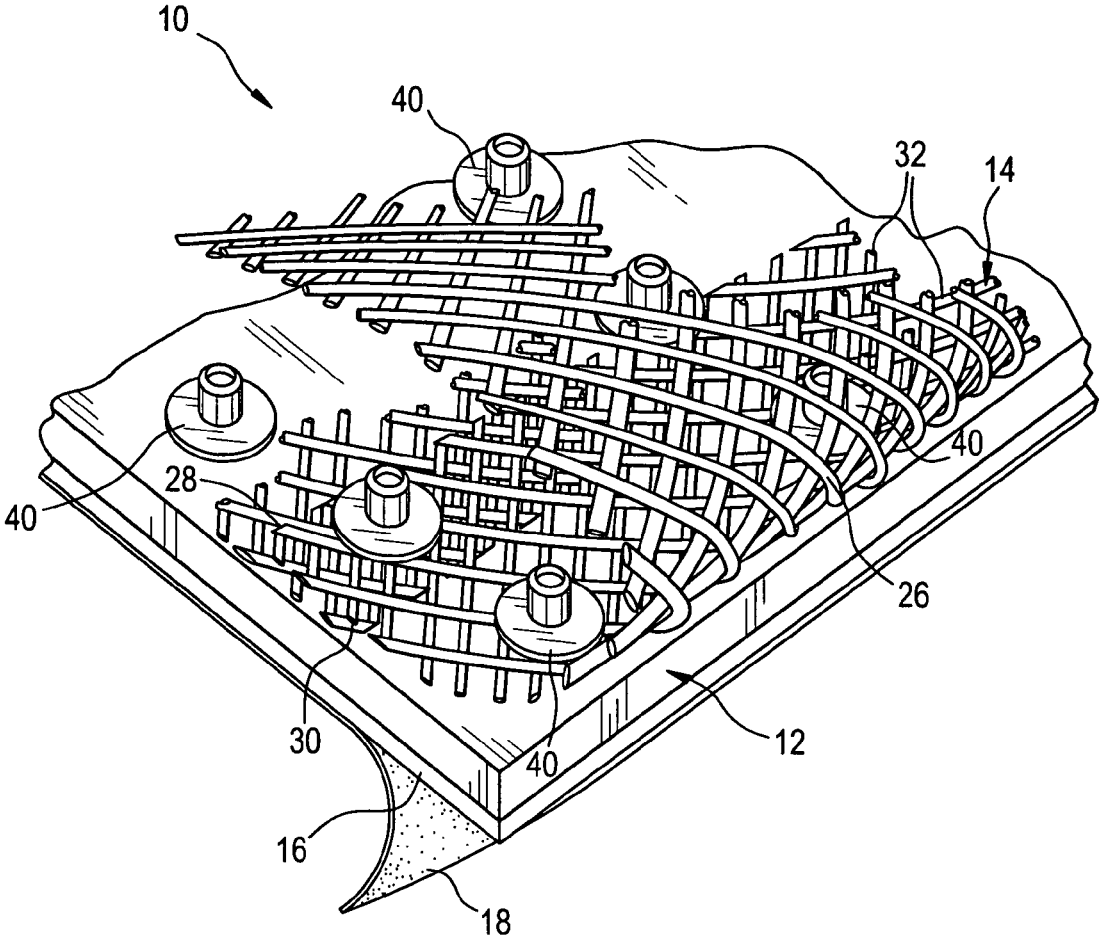
FIG. 1 is a fragmentary perspective view of a building material anchor in accordance with the present invention.
Figure 2:
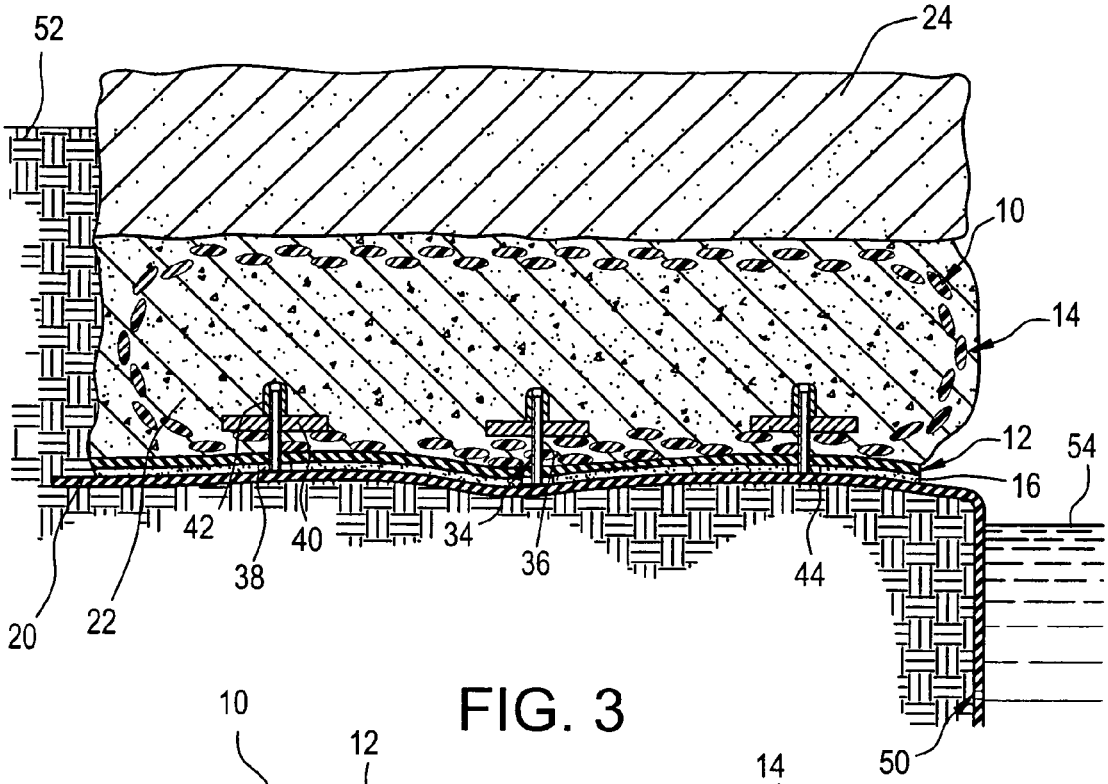
FIG. 2 is a cross-sectional view of the building material anchor of FIG. 1 shown securing a copingstone to the liner of a fish pond.
Figure 3:
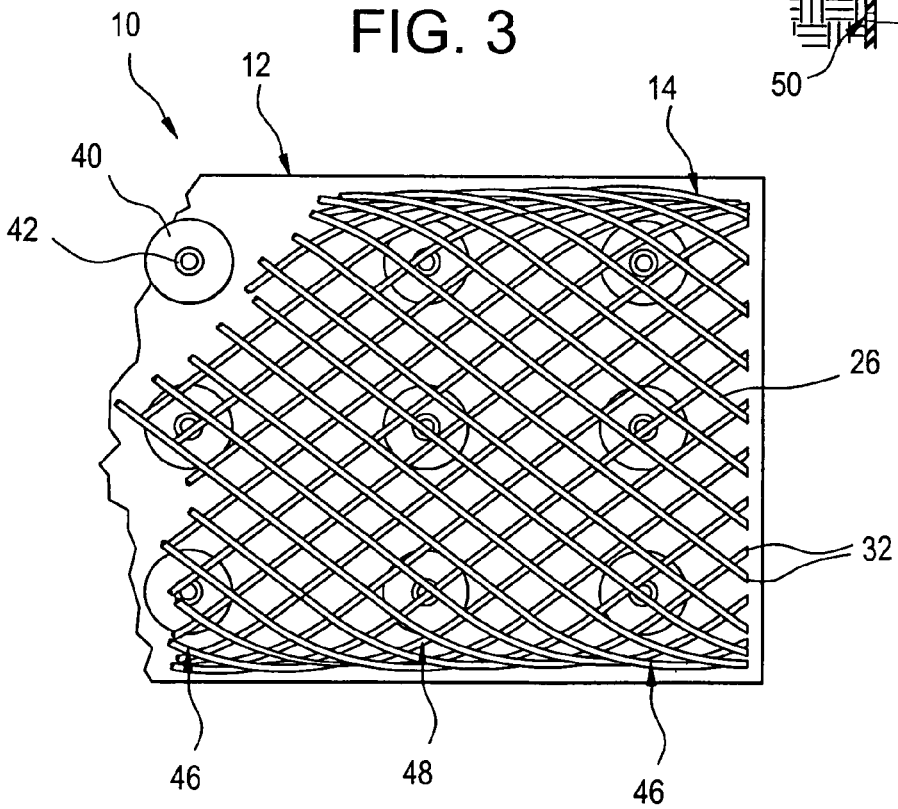
FIG. 3 is a top view of the building material anchor.

Referring now to the FIGS., a building material anchor in accordance with the present invention is shown at 10. Anchor 10 includes a pad 12 to the top of which is affixed an openwork tube 14. The bottom of pad 12 is coated with a pressure-sensitive adhesive layer 16. A protective release liner 18 covers adhesive layer 16 prior to use. During use, pad 12 is secured by means of adhesive layer 16 to a stable substrate 20 and openwork tube 14 is filled with cement 22. Atop openwork tube 14 is positioned a coping stone 24 that is affixed to substrate 20 by means of the cured cement 22 oozed through, and bonded to, openwork tube 14.

Pad 12 is formed of natural or synthetic rubber sheeting 0.04 inches (1 mm) thick. To permit anchor 10 to support one or more stones 24 of the sort used for coping backyard ponds, it has been found convenient to provide pad 12 with a length of 12 inches (30.5 cm) and a width of 5.5 inches (13.8 cm). Of course, the dimensions of pad 12, and all other features of anchor 10, can be scaled up or down to suit the needs of a particular user. If desired, too, heavy-duty textiles and plastic materials can be substituted for rubber sheeting in pad 12 since they permit anchor 10 to be readily attached to substrates 20 that are irregularly contoured. Should substrate 20 be flat or have regular contours, stiff materials formed of: metal, wood, fiberglass, stone, brick and cement can be used to construct pad 12.

Openwork tube 14 is formed from a sheet 26 of plastic mesh 0.0625 inches (1.6 mm) thick whose opposite ends 28 and 30 are rolled back upon one another so as to overlap. The length of the mesh sheet 26 is about 11.5 inches (29 cm) and the width of the mesh sheet 26 is about 12 inches (30.5 cm). The width of the overlap of ends 28 and 30 is about 1.5 inches (3.8 cm).

Mesh sheet 26 comprises a lattice of resilient plastic threads as at 32 about 0.04 inches (1 mm) in diameter. Parallel threads 32 are spaced about 0.16 inches (4 cm) apart and overlapping threads 32 intersect at right angles. At points of overlap, threads 32 are molded to one another for a strong connection. Metal screening or expanded metal mesh can be substituted for the plastic mesh 26, if sufficiently resilient to adapt to the contours of substrate 20 below and stone 24 above, but such materials may not be as lightweight and corrosion resistant as plastic.

A number of rivets 34 affix openwork tube 14 to pad 12. Each rivet 34 includes a hollow pin 36 having a peripheral flange 38 at its bottom that serves as a head. Fitted atop each pin 36 are a washer 40 and a retaining collar 42. By pressing, to the point of permanent deformation, the top of pin 36 outwardly into collar 42, washer 40 is locked upon pin 36. Flange 38 prevents washer 40 from slipping off the bottom end of pin 36 and collar 42 prevents washer 40 from slipping from the top.

In anchor 10, each pin 36 extends upwardly through a close-fitting hole 44 provided in pad 12 with flange 38 being retained by the small size of hole 44 against the bottom of pad 12. Washers 40 and collars 42 are positioned atop the overlapping ends 28 and 30 of mesh sheet 26 once positioned atop pad 12. Since washers 40 have a diameter of about 1 inch (2.54 cm) and cannot pass through the openings between threads 32 in mesh sheet 26, openwork tube 14 cannot be removed from pad 12 without damaging tube 14 in whole or in part.

Rivets 34 are shown to be evenly spaced in rows 46 and 48 having three rivets 34 each that extend across the width of pad 12. Two rows 46 are located at opposite ends of pad 12 and another row 48 is positioned midway between rows 46. Such a configuration evenly distributes loads from openwork tube 14 to pad 12, but any other desired configuration can be employed.

Any suitable means known in the art can be used to affix openwork tube 14 to pad 12. By way of example only, an adhesive cement can be employed. Furthermore, tube 14 and pad 12 can be sewn or stapled together. The use of buttons, buckles and clasps is possible.

A pressure-sensitive adhesive layer 16 is applied to the bottom of pad 12 at the time of manufacture of anchor 10 for securing anchor 10 to substrate 20. Adhesive layer 16 is preferably a nontoxic, contact-type glue that bonds readily and permanently to plastic. If desired, adhesive layer 16 can be formulated to provide optimum adhesion to substrates as diverse as wood, cement, and gypsum boards.

A removable release liner 18 covers adhesive layer 16 in order to keep such from becoming contaminated prior to use. Release liner 18 is formed of paper having at least one surface treated, as with silicone, for ready detachment from adhesive layer 16. Ordinarily, release liner 18 is retained on adhesive layer 16 until a user detaches it while making anchor 10 ready for use.

Should the qualities of the glue forming adhesive layer 16 not lend themselves to positioning such on pad 12 prior to use of anchor 10. The glue can be distributed in liquid form in a container or containers (not shown) along with previously joined pads 12 and openwork tubes 14 in the manner of a kit. A user would apply the glue to the bottom of a pad 12 at the time of use so as to form adhesive layer 16.

The use of building material anchor 10 in the construction of a backyard pond is straightforward and will be described with reference to a single stone 24 though multiple stones 24 and anchors 10 would normally be required. First, a hole 50 is dug in the ground 52 and lined with an impermeable plastic sheet or substrate 20. Then, taking an anchor 10 in hand, release liner 18 is pulled from pad 12 to expose adhesive layer 16. Now, anchor 10 is moved to a desired spot around the hole 50 and adhesive layer 16 is pressed against substrate 20, permanently bonding anchor 10 to substrate 20. Next, cement 22, or other semisolid material capable of adhering to stone, plastic and rubber, is troweled into openwork tube 14 so as to fill tube 14. For good measure, extra cement 22 can be troweled atop tube 14. Afterward stone 24 is positioned upon tube 14 thereby squeezing tube 14 and driving cement 22 into irregularities in the surface of stone 24 and the top of pad 12. Excess cement 22, if any, is now removed from the sides of anchor 10 and the cement 22 is permitted to cure. After curing, stone 24 is rigidly bonded to substrate 20 and cannot be removed without resort to blows from a hammer and chisel. Finally, water 54 is poured into hole 50 atop substrate 20 to provide a habitat suitable for the long-term growth and health of aqueous plants and fish. Repair of the structure of the pond constructed with anchor 10 should not be required for years.

While building material anchor 10 has been described with a high degree of particularity, it will be appreciated by those skilled in the art that modifications can be made to it. Therefore, it is to be understood that the present invention is not limited to the sole anchor embodiment described above, but encompasses any and all embodiments within the scope of the following claims.

I claim:

1. A building material anchor, comprising:

a resilient pad;

a resilient, openwork tube being positioned atop said pad;

a plurality of rivets affixing said openwork tube to said pad;

a pressure-sensitive adhesive layer coating the bottom of said pad; and, a protective release liner covering said pressure-sensitive adhesive layer.

2. A building material anchor, comprising:

a rubber pad;

a resilient, openwork tube being positioned atop said pad, said openwork tube being formed from a sheet of plastic mesh whose opposite ends are rolled back upon one another so as to overlap;

a plurality of rivets penetrating said opposite ends of said sheet of plastic mesh and said pad so as to affix said openwork tube to said pad;

a pressure-sensitive adhesive layer coating the bottom of said pad; and, a protective release liner covering said pressure-sensitive adhesive layer.

* * * * *